United States Patent [19]

Sharp

[11] 4,215,500

[45] Aug. 5, 1980

[54] VISUAL DISPLAY DEVICE

[76] Inventor: Gordon Sharp, 372 Memorial Dr., Cambridge, Mass. 02139

[21] Appl. No.: 824,920

[22] Filed: Aug. 15, 1977

[51] Int. Cl.[2] ..... G09F 19/00

[52] U.S. Cl. ..... 40/409

[58] Field of Search ..... 40/106.21, 106.22, 106.23, 40/106.25, 427, 409, 410, 326, 441, 439

[56] References Cited

U.S. PATENT DOCUMENTS

| | | | |
|---|---|---|---|
| 1,221,494 | 4/1917 | Wiley | 40/106.25 X |
| 1,350,542 | 8/1920 | Booth | 40/106.25 |
| 1,533,738 | 4/1925 | Kane et al. | 362/806 X |
| 1,824,388 | 9/1931 | Birch | 40/439 |
| 2,464,460 | 3/1949 | Pack | 40/106.25 |
| 2,721,256 | 10/1955 | Duhon | 362/811 |
| 2,785,895 | 3/1957 | Neveling | 272/8 R |
| 2,911,745 | 11/1959 | Simon | 40/106.22 |
| 3,144,730 | 8/1964 | Johnson | 46/91 |
| 3,174,688 | 3/1965 | Chatten | 40/106.25 |
| 3,180,043 | 4/1965 | Larson | 40/439 |
| 3,536,908 | 10/1970 | Oster | 40/132 E |
| 3,589,044 | 6/1971 | Morrison | 40/106.22 |
| 3,692,382 | 9/1972 | Clotier | 40/409 |
| 3,744,166 | 7/1973 | Rielle | 40/106.21 |
| 3,814,318 | 6/1974 | Michaelis | 239/23 |
| 3,905,140 | 9/1975 | Damiano | 40/106.25 |

FOREIGN PATENT DOCUMENTS

| | | | |
|---|---|---|---|
| 1139230 | 10/1950 | Australia | 40/406 |
| 701037 | 12/1953 | United Kingdom | 40/106.25 |

OTHER PUBLICATIONS

Chemical Engineering Handbook: McGraw-Hill 1973.
"Glitterlamps" by Fantasia—2 pp.
Lava Simplex Internationale: "Lava Light" literature; 6 pieces.
Constellations Inc. literature; 3 pp.

*Primary Examiner*—Louis G. Mancene
*Assistant Examiner*—Wenceslao J. Contreras
*Attorney, Agent, or Firm*—Weingarten, Maxham & Schurgin

[57] ABSTRACT

A display device for creating amusing visual effects from the motion of beads of expanded polystyrene or similar materials in a stream of flowing air, accompanied by the audible effects attendant thereto. An air flow is introduced into the bottom of a vertical, transparent column into which has been placed a plurality of beads sufficiently small to be floated by the stream of air. The top and bottom openings of the vertical column are closed by wire screens to contain the beads while allowing air to pass. Colored lights may be employed to illuminate the top and bottom regions of the column.

16 Claims, 5 Drawing Figures

VISUAL DISPLAY DEVICE

FIELD OF THE INVENTION

This invention relates to the field of kinetic art and visual effect display devices and, more particularly, to the same as applied to amusement items.

BACKGROUND OF THE INVENTION

Decorative display devices for the production of interesting visual effects have been employed in recent years as amusement devices, attention-getters, elements of advertising displays and the like. While such prior art display devices have taken many forms, it is specifically noted that visual display devices employing a fluid medium to suspend or agitate either a second fluid or particles have heretofore been available in the prior art. However, unlike the present invention, the fluid medium in such devices has been limited to liquids, and the motion of the liquid has been due to thermally induced convection currents and due to the liquid properties, the visual effects have been limited.

BRIEF SUMMARY OF THE INVENTION

In accordance with the present invention, air is employed, rather than a liquid, in combination with a sufficiently bouyant particle as a basic mechanism for generating visual display of unusual interest and versatility. A pressurized stream of air is introduced into a lower end of a column through chamber or containment means in which a large number of particles, such as beads of expanded polystyrene, have been placed. The pressurized air flow agitates the beads and causes them to be carried or floated upward into the column, generating interesting visual effects. Further, the collision of the beads against the walls of the column produces an audible effect similar to the white noise type of effect produced by raindrops falling on a roof. The top end of the column is closed by a wire mesh. This upper mesh serves both to contain the beads within the column and to control the pressure drop along the length of the column, to maintain an upper region therein that is relatively free of flying beads.

Colored lights are optionally provided at the top and bottom of the chamber to shine onto the beads, and variously-shaped baffles may be inserted at the bottom of the column to manipulate or tailor the air flow as it enters the column. In this way, the action of the beads can be made to resemble such varied effects as a fire, a boiling liquid, an erupting volcano, wave action, and a driving blizzard. The user has control over the type of bead action generated at any given time and can produce an appropriate visual display to reflect the mood or feeling of the moment.

The visual display thus produced is intended principally to be used as a personal amusement item. Additional, commerical uses are also envisioned, such as in advertising displays or, on a large scale, as a fixture in shopping malls and the like.

BRIEF DESCRIPTION OF THE DRAWINGS

These and other features of the present invention are more fully described below in the detailed description of the preferred embodiment, presented for purposes of illustration and not by way of limitation, and in the accompanying drawing of which.

DETAILED DESCRIPTION OF A PREFERRED EMBODIMENT

Figure 1:
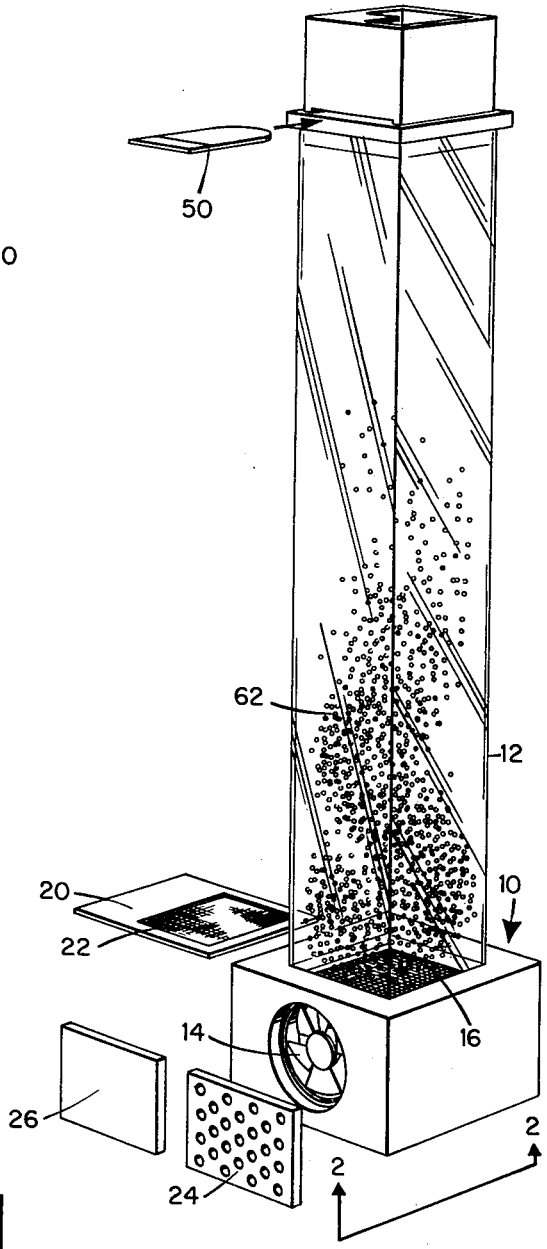
FIG. 1 is a perspective, pictorial view of the preferred embodiment of the present invention.

The present invention contemplates an apparatus for generating interesting displays, in which relatively small, lightweight particles or beads, such as polystyrene beads of up to several millimeters in diameter, are agitated by a pressurized stream of flowing air to produce interesting visual effects and accompanying audible sound. As illustrated in FIG. 1, a base 10 is provided for supporting a vertical column or chamber 12. An electric fan 14 placed at an opening in a side wall of base 10 draws ambient room air into the interior of the base, by which action the pressure within the base is raised and the pressurized air is forced to flow out of the base through an opening in the top thereof. A wire mesh or screen 16 is provided to prevent the beads from falling into the base.

Vertical column 12 is fitted into and received by the opening in the top of base 10. Although column 12 is shown as having a square cross-sectional shape, it need not be so limited, other shapes such as circular, rectangular, and triangular cross-sections being usable. It has been empirically ascertained that for a square column or chamber, a height to width ratio of between 4 to 1 and 6 to 1 is adequate for allowing a wide range of degrees of bead agitation. These measurements assume that with the fan stopped the beads will fill the column to a height of about one-half the length of a side of the square. Of course, since visual effects require observation by a viewer, the column 12 must be made of a transparent material such as a clear plastic, plexiglass or glass, the precise choice depending upon factors such as cost of raw stock and assembly cost and not being critical to the proper operation of the invention.

A slot 18 is provided in the side of base 10 just below screen 16 for receiving a removable baffle 20. Baffle 20 comprises a thin sheet of material, such as plastic, cardboard or wood, having a region 22 which is in some way permeable to the pressurized air flow supplied from base 10. Region 22 may simply contain one or more holes of the same or different shapes so that air will always be blown through the baffle in selected isolated areas only or, alternatively, region 22 may comprise a large cut-out area covered with a material of tighter mesh than screen 16, to produce a large pressure drop and an evening of the distribution of air pressure supplied across the cross-section of the column. Users may vary the type of action displayed by the beads according to the choice of baffle. Optionally, the baffle may be integral to the structure of the opening in the top of the base 10; for example, it may even be a movable plate controlled by a motor assembly, to automatically vary the distribution of air pressure applied to the bottom of the column is some cyclic fashion.

The action of the beads in the column may also be controlled by changing the air pressure generated by fan 14. One method of accomplishing this is to employ a fan motor having an externally adjustable speed, with the user being given access to the speed control. Another method, for use with a constant speed motor, is to vary the aperture through which air is drawn into the base. For this purpose, either a perforated baffle 24 or a solid baffle 26 may be placed over all or part of the opening in base 10 through which fan 14 draws its intake air flow.

Figure 2:
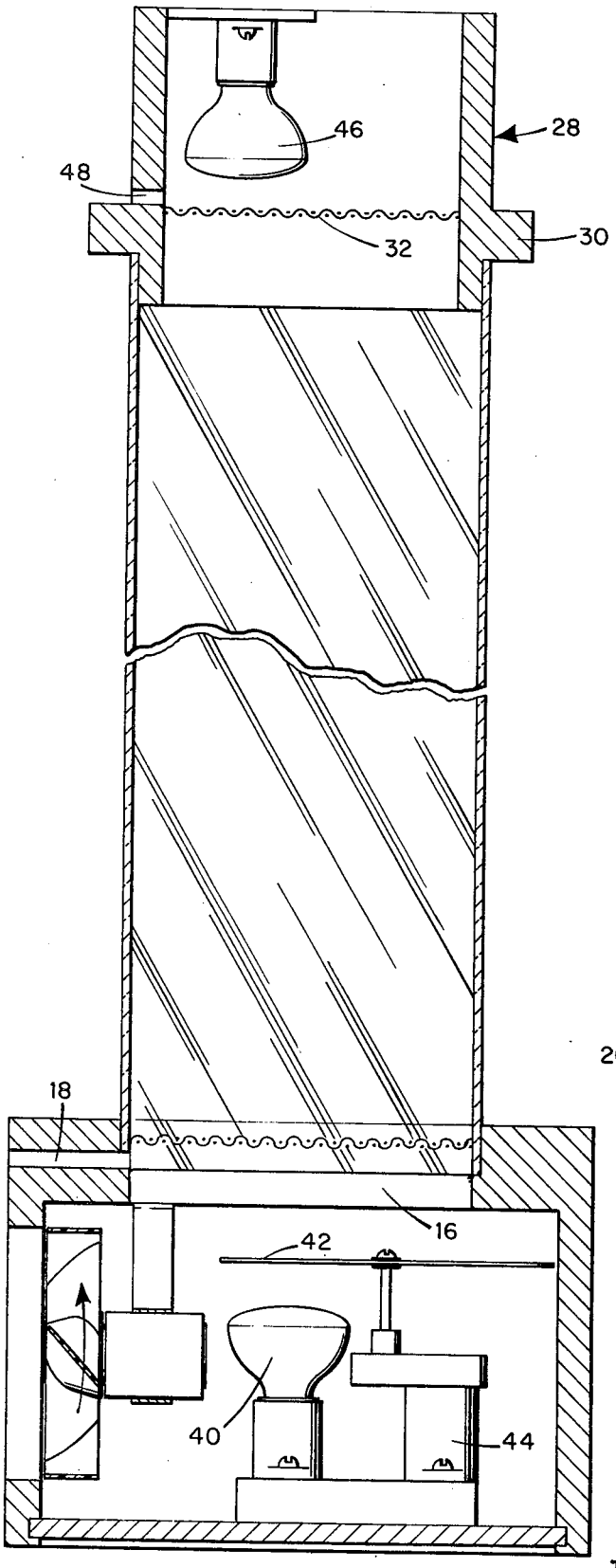
FIG. 2 is a cross-sectional view of the apparatus of FIG. 1 taken along line 2—2 of FIG. 1.
Figure 5:
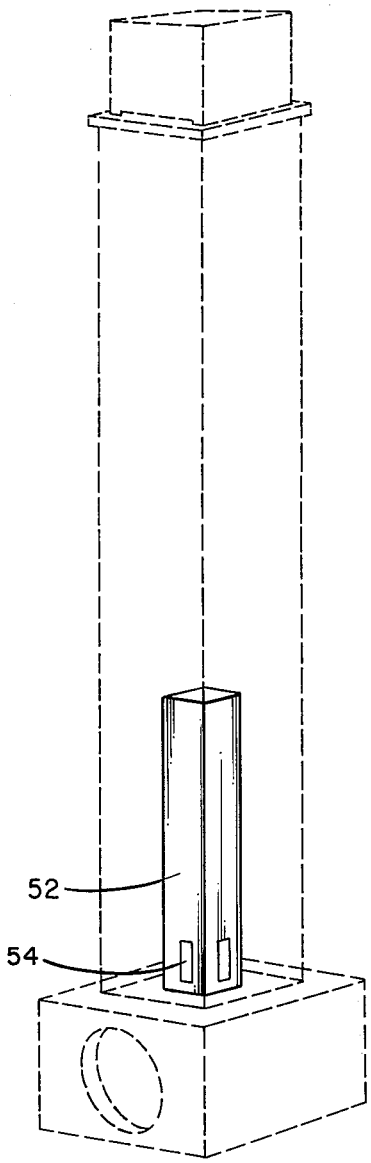
FIG. 5 is a perspective, pictorial view of the apparatus of FIG. 1 showing the addition thereto of an air jet to provide a concentrated stream of beads within the active display area.

As a further option, as shown in FIG. 5, one or more air jets 52 may be provided for collecting beads and shooting them into the active area within the column in a concentrated stream. A jet suitable for use with the embodiment of FIGS. 1 and 2 would simply comprise a tube about one-third to one-fourth as high as the column and one-half as wide thereas, with an opening 54 at the bottom to receive beads. The tube provides a partition within the chamber, permitting an enhanced flow of beads therefrom.

A housing 28 is provided at the top of column 12. As illustrated, the housing is of conforming shape to the inside surface of the top of the column and has a shoulder 30 for supporting the housing on the top of the walls of the column. A mesh or screen 32 is supported by housing 28 and closes off the top of column 12. This top screen has two purposes. The first is the obvious one of helping to contain the beads in the column. The second is to center the action of the churning beads into principally the bottom half to two-thirds of the column. This result is desired because it tends to produce a pleasing visual effect, with single beads or groups of beads occasionally squirting forth from the general mass of beads into the top third of the column. The screen produces this centering function by acting to form what is essentially a type of soft-limiting feedback loop. Assuming that initially screen 32 presents little impediment to the flow of air, if the pressure generated at bottom screen 16 is sufficient there will come a point at which beads are thrown up near screen 32. In fact, if the pressure at the bottom is sufficient, then the air pressure at the top of the column will be high enough to hold some beads against top screen 32. If a sufficient number of beads collect at screen 32, the effective surface area of the aperture at the top of the column will thereby be reduced, increasing the pressure drop across the screen. This will in turn reduce the pressure gradient between the bottom and top of the column and concommitantly reduce the amount of air flowing into the column. Consequently, fewer beads will be thrown up near the top to collect against screen 32. This will continue until the center of the mass of beads has moved downward until a point of equilibrium has been established.

The visual effects produced by the swirling, agitated beads within the column may be enhanced by applying colored lights thereto. For this purpose, a first lamp 40 is provided within base 10. A color wheel 42 is supported above bulb 40 to provide colored light therefrom. A motor assembly 44 rotates color wheel 42 so that the color applied to the bottom of the column varies periodically with rotation of the color wheel. A second lightbulb 46 is supported within housing 28 and is directed downward into the top of the column. A slot 48 is provided in housing 28 for receiving a slide 50 of colored glass or other transparent material beneath bulb 46, to provide colored light therefrom. It is desirable that slide 50 should be placed close to screen 32 so that very little air will pass through the part of the screen covered by the slide, preventing beads from clustering in this area and obstructing the light provided by bulb 46. Beads 60 may be either white or colored, in one or more different colors. In the event that it is desired to dispense with bulbs 40 and/or 46, the use of colored beads provides an alternative way to introduce the aspect of color into the visual display produced by beads 60.

While in general round or oval-shaped beads may be the easiest to obtain, particularly interesting visual effects may be produced by using beads of other shapes, such as malformed beads sometimes found in batches of polystyrene beads, the latter being somewhat oblong-shaped and usually having a large open or closed cavity. Due to the existence of the cavity, these beads tend to be lghter than normal beads and yet have greater surface area. They therefore tend to be thrown up above the rest of the beads in the column and flutter around in the empty space above the majority of the more vigorously churning, denser beads.

Figure 3:
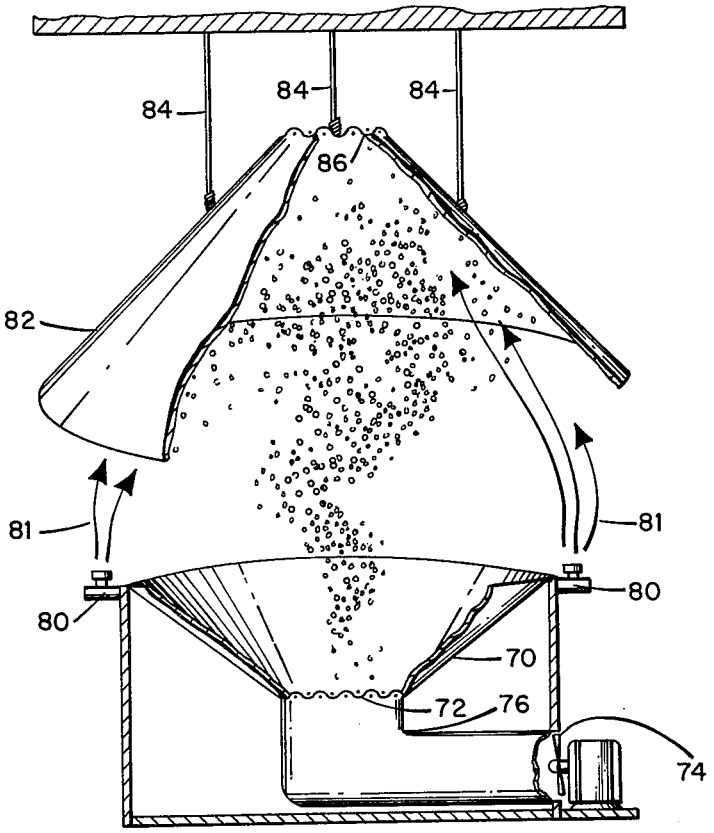
FIG. 3 is a diagrammatic, cross-sectional illustration of an alternative embodiment of the present invention showing the use of an "air curtain" to contain the beads.
Figure 4:
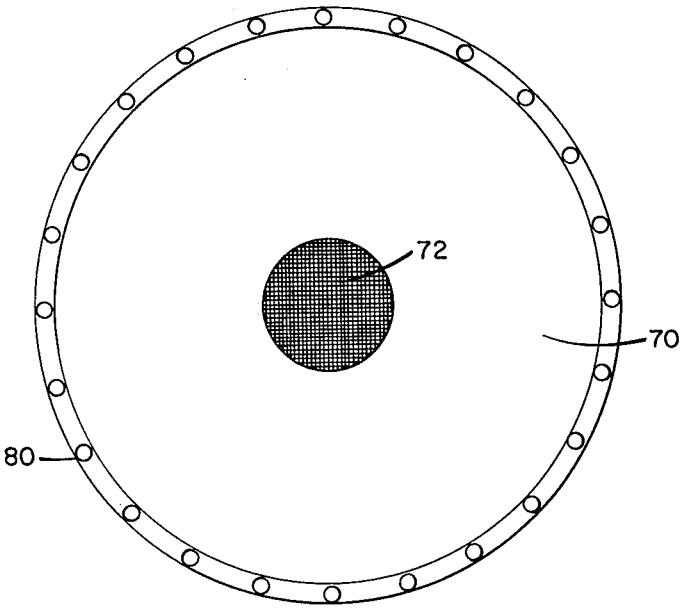
FIG. 4 is a top view of the base of the apparatus of FIG. 3.

It should be realized that the chamber structure can be varied considerably within the scope of this invention. For example, the chamber may be built against all or part of a wall, utilizing the surface of the wall as one side of the chamber. The shape of the column may also be modified from a simple upright structure by, for example, incorporating branch-like projections from the main column. In still a further variation the solid walls of the column may be dispensed with entirely and replaced with so-called "air curtains" for providing a boundary perimeter for containing the beads. A suggested embodiment of this type is illustrated in FIGS. 3 and 4. As shown there, the base has been modified so as to form a frusto-conical surface 70 with a central opening for receiving a screen 72. Air is supplied for agitating the beads through screen 72 as, for example, by air jets or the indicated fan 74 and duct 76. Surface 70 is ringed at its outer edge by air jets 80 which supply a fast flowing, forceful stream of air generally upwardly directed to form an air curtain for containing the moving beads. At the top, the apparatus is closed by a frusto-conical collecting surface 82 which may be hung from a framework or suspended from the ceiling of the display area by cables 84. The top, smaller end of collecting surface 82 is closed by a screen 86 which functions similarly to screen 32 in the earlier illustrated embodiment. Most of the action of the beads will take place in the bottom central area of the display region for moderate air pressures introduced through screen 72, since the pressure will be rapidly dissipated. Wayward beads which move outward from the central area will encounter the air curtain produced by air jets 80 and be carried upward in the air flow of jets 80 into the collector cone 82. Due to the presence of screen 86 which closes the central opening of the collector cone, the air pressure from the air curtain stream rapidly drops in the region of the collector cone until it can no longer support the beads, so that the beads will then fall back into the central, active region of the display. Any beads which should fall back against base cone 70 will simply roll inwardly toward screen 72 and be carried upward by the agitated air flowing therethrough.

Although not shown in FIGS. 3 and 4, any number of colored lights, of either fixed or changing colors may be played upon the churning beads.

Having thus described a preferred embodiment for the present invention, and alternative thereto, it is nev-ertheless realized that it will occur to those skilled in the art to modify the disclosed structures within the spirit of the invention. It is accordingly intended to limit the scope of the invention only as indicated in the following claims.

What is claimed is:

1. A kinetic, visual display apparatus comprising:

means for establishing a pressurized, flowing stream of air;

means for defining a column containing a visually perceivable volume;

a plurality of lightweight expanded plastic beads of generally rounded exterior surface without substantial convolutions, said beads disposed in said volume;

said volume containing first and second openings at the boundary thereof;

said openings being operatively closed by screening having a mesh size small enough to prevent the passage of said beads therethrough;

the first opening in the boundary of said volume being at a lower elevation than the second opening;

the pressurized, flowing stream of air being introduced into said volume through said first opening therein, to agitate and generally float and thereby suspend the beads within said volume, whereby a kinetic, visual display is produced; and means for projecting illumination into said volume to permit visual perception of said beads.

2. The apparatus of claim 1 wherein said means for establishing a pressurized flowing stream of air comprises partition means within the chamber for providing an enhanced flow of beads therefrom.

3. The apparatus of claim 1 wherein said means for defining a volume comprises a plurality of air jets for establishing an air curtain to partially enclose said volume.

4. The apparatus of claim 3 wherein said means for defining a volume further comprises a lower or base surface and an upper or collecting surface, said base surface defining said first opening and said collecting surface defining said second opening.

5. The apparatus of claim 4 further comprising:

a base housing or chamber having first and second openings;

said means for establishing a pressurized, flowing stream of air comprising a fan;

said fan being disposed to draw air into the base through the first opening therein; and the lower opening of the chamber being operably connected to the second opening of the base whereby the fan provides the pressurized, flowing stream of air to the chamber through the second opening in the base.

6. The apparatus of claim 5 wherein the beads are formed of expanded polystyrene material.

7. The apparatus of claim 6 wherein the interior of the chamber is at least partially illuminated by at least one light.

8. The apparatus of claim 4 further comprising baffle means adjacent the lower opening of the chamber for controlling the air pressure distribution introduced to the interior of the chamber through said lower opening.

9. The apparatus of claim 4 wherein said plurality of beads includes non-spheroidal beads having greater surface area than spheroidal beads of like mass.

10. The apparatus of claim 4 wherein said means for establishing a pressurized flowing stream of air comprises partition means within the chamber for providing an enhanced flow of beads therefrom.

11. The display apparatus of claim 1 wherein said illumination projecting means is located to project illumination into said volume through said first opening substantially in and with the flow direction of said flowing stream.

12. The display apparatus of claim 1 wherein said expanded plastic beads include expanded polystyrene plastic beads.

13. The display apparatus of claim 1 wherein:

said first opening extends substantially from wall to wall of said column;

said means for establishing a pressurized, flowing stream of air includes means for applying air to substantially the whole of said first opening.

14. The display apparatus of claim 1 wherein said second screened opening includes means for accumulating a plurality of beads thereon to provide flow regulation of the presurized flowing stream of air flowing through said column.

15. The display apparatus of claim 1 further comprising baffle means adjacent the first opening of the volume for controlling the air pressure distribution introduced to the interior of the volume through said opening.

16. The display apparatus of claim 1 further comprising means for adjusting the velocity of the flowing stream of air introduced to the volume through the first opening thereof.

* * * * *